US005769956A

United States Patent [19]

Cord et al.

[11] Patent Number: 5,769,956

[45] Date of Patent: Jun. 23, 1998

[54] METHOD FOR CLEANING A SCREEN BY SPRAYING AND MOVING IN A REPEATED CONTINUOUS OSCILLATING MOTION

[75] Inventors: Albert B. Cord; Cameron W. Cord, both of Cincinnati, Ohio; David N. Gehrich, St. Paul, Ind.; Gregory N. Jensen, Westchester; Ted K. Parr, Cincinnati, both of Ohio

[73] Assignee: Intercontinental Chemical Corporation, Cincinnati, Ohio

[21] Appl. No.: 826,287

[22] Filed: Mar. 27, 1997

Related U.S. Application Data

[60] Continuation of Ser. No. 652,372, May 23, 1996, abandoned, which is a division of Ser. No. 384,737, Feb. 7, 1995, Pat. No. 5,566,697.

[51] Int. Cl.[6] ..... B08B 3/02

[52] U.S. Cl. ..... 134/10; 134/148; 134/153; 134/157; 134/165; 134/32; 134/34

[58] Field of Search ..... 134/10, 23, 24, 134/254, 255, 32, 34, 42, 109, 148, 153, 155, 157, 165

[56] References Cited

U.S. PATENT DOCUMENTS

| | | | |
|---|---|---|---|
| 2,131,406 | 9/1938 | Mosmieri et al. | 134/165 X |
| 2,682,213 | 6/1954 | Shapiro | 134/151 X |
| 3,314,819 | 4/1967 | Dyer | 134/32 |
| 3,343,555 | 9/1967 | Kasner | 134/111 |
| 3,405,720 | 10/1968 | Carlson | 134/148 X |
| 3,580,261 | 5/1971 | Key | 134/148 X |
| 3,656,493 | 4/1972 | Black et al. | 134/113 |
| 3,930,879 | 1/1976 | Erickson et al. | 134/109 X |
| 4,420,004 | 12/1983 | Jensen | 134/96 |
| 4,561,903 | 12/1985 | Blaul | 134/10 |
| 4,664,721 | 5/1987 | Valasek | 134/26 |
| 4,717,426 | 1/1988 | Brynildsen | 134/26 |

(List continued on next page.)

FOREIGN PATENT DOCUMENTS

| | | |
|---|---|---|
| 0 057 966 | 8/1982 | European Pat. Off. . |
| 0057966 | 8/1982 | European Pat. Off. . |
| 3 017 180 | 11/1981 | Germany . |
| 3017180 | 11/1981 | Germany . |
| 58 132 562 | 8/1983 | Japan . |
| WO 90 05065 | 5/1990 | WIPO . |
| WO 9005065 | 5/1990 | WIPO . |
| WO 91 15370 | 10/1991 | WIPO . |
| WO 9115370 | 10/1991 | WIPO . |
| WO US 96 24492 | 8/1996 | WIPO . |
| WO US9624492 | 8/1996 | WIPO . |

OTHER PUBLICATIONS

Patent Abstract of Japan–JP.A.58 132562 Nov. 1983 Advertising for Perfecta 'S' XP002006526, pp. 1–4, Published May 1988.

Advertising for Perfecta 'S' XP0092006526, pp. 1–4, Published May 1988.

*Primary Examiner*—Lyle A. Alexander

*Attorney, Agent, or Firm*—Wood, Herron, Evans, L.L.P.

[57] ABSTRACT

Method by an oscillator screen cleaning apparatus includes an enclosed housing which forms a cleaning chamber having a plurality of spray nozzles positioned therein to spray a printing screen with cleaning solvent. An oscillating mechanism is mounted within the cleaning chamber to move the screen in an oscillating motion in front of the spray nozzles to provide an efficient and effective cleaning of the printing screen. The spray nozzles are arranged in two opposing grid patterns and the screen is oscillated between the grid patterns to provide complete coverage of the screen with spray cleaning solvent. The sprayed solvent is collected, filtered and resprayed onto the screen, and the high spray rate of the apparatus ensures effective cleaning with the re-used solvent. The entire spray system is enclosed within a housing which is coupled to a vapor recovery system so that solvent and solvent vapors do not escape into the environment. The apparatus provides rapid and efficient cleaning of the printing screen with cost-effective re-use of the solvent and contaminant of the solvent to produce a safer work environment.

12 Claims, 2 Drawing Sheets

U.S. PATENT DOCUMENTS

| | | | |
|---|---|---|---|
| 4,739,780 | 4/1988 | Czaja et al. | 134/131 X |
| 4,808,237 | 2/1989 | McCormick et al. | 134/26 |
| 4,826,539 | 5/1989 | Harpold | 134/10 |
| 4,865,061 | 9/1989 | Fowler et al. | 134/109 X |
| 5,032,187 | 7/1991 | Lawless | 134/32 |
| 5,113,882 | 5/1992 | Gileta | 134/34 X |
| 5,197,384 | 3/1993 | Yawata et al. | 101/123 |
| 5,206,970 | 5/1993 | Johnson | 15/321 |
| 5,220,933 | 6/1993 | Albers | 134/58 R |
| 5,372,153 | 12/1994 | Dobson | 13/165 X |

METHOD FOR CLEANING A SCREEN BY SPRAYING AND MOVING IN A REPEATED CONTINUOUS OSCILLATING MOTION

This application is a continuation of application Ser. No. 08/652,372, filed May 23, 1996, now abandoned which in turn is a divisional of Ser. No. 08/384,737, filed Feb. 7, 1995 now 5,566,697.

FIELD OF THE INVENTION

This invention relates generally to screen printing and specifically to apparatuses and methods for cleaning printing ink and other materials from printing screens and frames used in screen printing.

BACKGROUND OF THE INVENTION

Screen printing, also known as serigraphics, is the process of transferring an image to a substrate by the use of a printing screen through which ink is squeezed. The ink is then deposited in all places on the substrate except where the screen has been processed by a photographically applied image depicting the places where ink is not to be forced through the screen mesh. The imaged screen mesh is normally made of silk, plastic or metal and is held in place by a screen frame made of wood, plastic or metal. The ink contains pigment or dye in an appropriate vehicle.

Screen cleaning requires the removal of all ink residue from the screen and frame when the printing is completed. Methods currently utilized to clean printing screens involve spraying the screen with pressurized solvent from a nozzle or gun structure. Many spraying techniques, however, result in overspray which directs solvent where it is not desired thereby wasting solvent and increasing the costs and inefficiency of the procedure. Additionally, spray cleaning methods usually require the use of paid workers thus raising the costs of cleaning and also exposing the workers to the solvent and solvent fumes.

Several attempts have been made to develop a cleaning procedure and apparatus which eliminates the various drawbacks of the above-mentioned procedures. For example, U.S. Pat. No. 3,580,261 discloses a printing screen cleaner which utilizes two vertically oriented lines of nozzles which oppose each other inside a cleaning enclosure. A screen is passed on a conveyer belt through the opposing nozzle lines whereupon it is sprayed with pressurized solvent. While eliminating several of the drawbacks of the above-discussed existing methods, the cleaner has other drawbacks which prevent the efficient and effective cleaning of a printing screen. Specifically, it utilizes only two opposing lines of spray nozzles within the enclosure and, therefore, each area of the screen is sprayed only once as the screen passes through the opposing nozzle lines. The screen is generally not adequately cleaned when the cleaning cycle has been completed and, therefore, the screen must be taken and passed through the cleaner additional times for additional cleaning cycles until it is sufficiently clean. As may be appreciated, such a task is time consuming and costly, and requires continuous worker supervision of the cleaning machine. For example, the work involves handling the screen by insertion into the machine, removal and manual brush agitation, then reinsertion, to insure adequate cleaning. Therefore, the cleaner disclosed in the '261 patent is not very efficient or cost effective.

The screen washing apparatus of U.S. Pat. No. 3,656,493 utilizes an enclosure and a single spray nozzle which is directed over the screen by a control mechanism to spray a predetermined pattern. Specifically, the nozzle sweeps horizontally in one direction across the screen to an end position and is then ratcheted down a few rows of the screen whereupon it sweeps in the opposite direction to an opposite end position and is ratcheted down to begin the process again. The nozzle continuously sweeps and ratchets until it reaches a bottom position which is pre-set by an operator. The screen is swept only once by the nozzle and if any portions remain dirty, the operator must remove the nozzle and manually spray the screen. Furthermore, the single nozzle only sprays a small area of the screen at any given time. Again, such a screen washing apparatus is neither efficient nor cost effective because the cleaning process has to be monitored to ensure that the single sweep was sufficient to remove the printing ink and the screen must be manually sprayed if the single sweep was not sufficient. Furthermore, the gun is controlled with manual pre-sets which must be adapted to spray a particular screen size, and insertion of a different size screen into the washing apparatus requires additional programming of the spray pattern of the device, thus further reducing the efficiency and cost effectiveness of the apparatus. Additionally, the operator is exposed to solvent fumes whenever it is necessary to manually direct the gun to completely clean the screen.

The screen cleaning apparatus of U.S. Pat. No. 4,420,004 utilizes a single row of adjacent nozzles which moves horizontally with respect to a screen to spray the screen and remove the printing ink as well as the stencil or print pattern. The single row of spray nozzles requires a continuous back and forth sweeping motion of the nozzle row which must be repeated until the screen is adequately cleaned. Since there is only a single line of nozzles, only a small area of the screen is sprayed at any one time leaving the remaining area unsprayed until the nozzle line again passes over that area. This increases the time that is required to adequately clean the screen because when one small area of the screen is being sprayed, the remaining area of the screen is dormant. As a result, the cleaning cycle of the apparatus in the '004 patent is inefficient and, therefore, not cost effective.

In view of the above background, there is a need for a screen cleaning apparatus which rapidly and efficiently cleans a printing screen and frame with little or no supervision by operators and other personnel, thereby making the apparatus very cost effective. Such a cleaning apparatus should also adequately and efficiently clean a screen in a single cleaning cycle without requiring removal of the screen and re-insertion into the cleaning apparatus for continual repetition of the cleaning cycle. It would be highly desirable to provide a cleaning apparatus which catches and reuses the sprayed solvent while maintaining a closed spray environment to prevent the escape of solvent and solvent fumes into the surrounding area or atmosphere.

SUMMARY OF THE INVENTION

This invention solves the problems associated with known apparatuses and methods for cleaning screens. The method and apparatus of this invention also satisfy the aforementioned needs that exist in the art as developed in the background of this invention.

The screen cleaning apparatus of the present invention includes an enclosed housing which forms a cleaning chamber for receiving a printing screen and a plurality of spray nozzles positioned inside the cleaning chamber to spray the screen with a cleaning solvent or other cleaning liquid. An oscillating mechanism is mounted within the cleaning chamber and moves the screen in an oscillating motion within the chamber in front of the spray nozzles. The oscillating movement and the plurality of spray nozzles yields repeated and increased screen coverage with sprayed cleaning liquid to provide improved cleaning and removal of undesired printing inks and other contaminants from the screen and surrounding frame in a single cleaning cycle. A guide keeps the oscillating screen at the proper orientation with respect to the spray nozzles.

One embodiment of the oscillator screen cleaning apparatus of the present invention utilizes two opposing pluralities of spray nozzles wherein the individual nozzles of each plurality are arranged in opposing grid patterns at horizontally and vertically spaced-apart nozzle positions. The screen is oscillated between the opposing nozzle pluralities, and the grid patterns provide increased screen coverage with the sprayed cleaning liquid or solvent. As the screen is oscillated, the entire screen area is constantly being sprayed with solvent. The opposing grids of spray nozzles are operable to deliver sprayed cleaning solvent to a screen at a rate, for example, of about 150 to about 180 gallons per minute, depending on the machine size, to effectively clean the screen.

A reservoir is positioned beneath the pluralities of spray nozzles to catch used cleaning liquid which falls from the screen, and a pump coupled between the reservoir and the nozzles pumps the used cleaning solvent to the nozzles to thereby recycle the solvent. The high recirculation of the cleaning solvent provided by the pump keeps the ink particles suspended in the solvent to prevent the reservoir from becoming clogged with ink sludge which would reduce its effectiveness. In addition, a reservoir which is kept clean requires less maintenance. A filter coupled between the pump and the spray nozzles removes filterable particles from the recycled cleaning fluid. The supply reservoir which holds the recycled cleaning solvent is also connected to a decantation drum which receives used solvent from the reservoir and holds the solvent for settling of the suspended contaminants and subsequent decanting of the cleaning solvent for reuse. The cleaning apparatus is enclosed in a housing to prevent the cleaning solvent and solvent fumes from entering the atmosphere or area adjacent the cleaning apparatus. Further, a vapor recovery system is coupled to the housing to remove vaporized cleaning solvent.

In one embodiment of the present invention, the oscillating mechanism moves the screen in an oscillating motion having a period of motion in the range of about 3 to about 20 inches, and preferably around 10 inches. The mechanism operates to move the screen in a complete period of the oscillating motion approximately 20 times per minute. The continuous oscillation of the screen in combination with the opposing grids of spray nozzles provides repeated application of the spray pattern onto the screen for excellent cleaning coverage. Furthermore, during the entire cleaning cycle of the oscillator screen cleaning apparatus of the present invention, each area of the screen is continually being sprayed resulting in a faster more efficient cleaning cycle which does not have to be continually repeated as required with other known screen cleaning apparatuses. The present invention thus provides rapid cleaning of ink and other printing materials from a printing screen and surrounding frame with the attainment of very clean screens and screen frames.

Advantages of the apparatus include a high impingement spraying system to improve ink removal; full screen and frame cleaning through oscillating motion; low maintenance reservoir tank; high volume/low maintenance filter system to reduce nozzle maintenance; quick drain system to empty risers of product which decreases cycle time (no need to wait for nozzles to stop spraying); air curtain venting system to reduce operator exposure to fumes and adjustable stop guide for varying screen sizes.

DETAILED DESCRIPTION OF THE INVENTION

Figure 1:
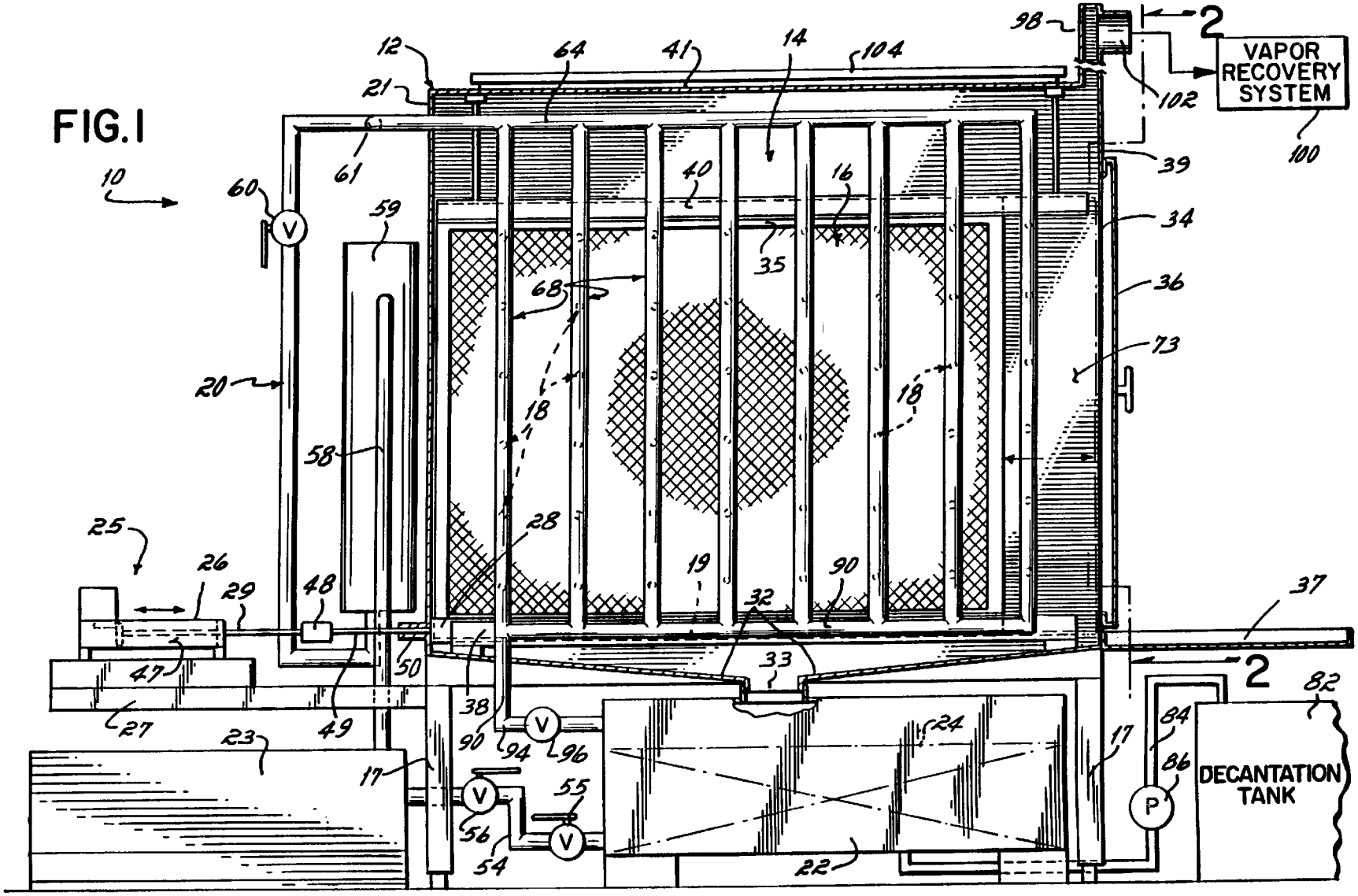
FIG. 1 is a side view, in partial cross-section, of an embodiment of the oscillator screen cleaning apparatus of the present invention.
Figure 2:
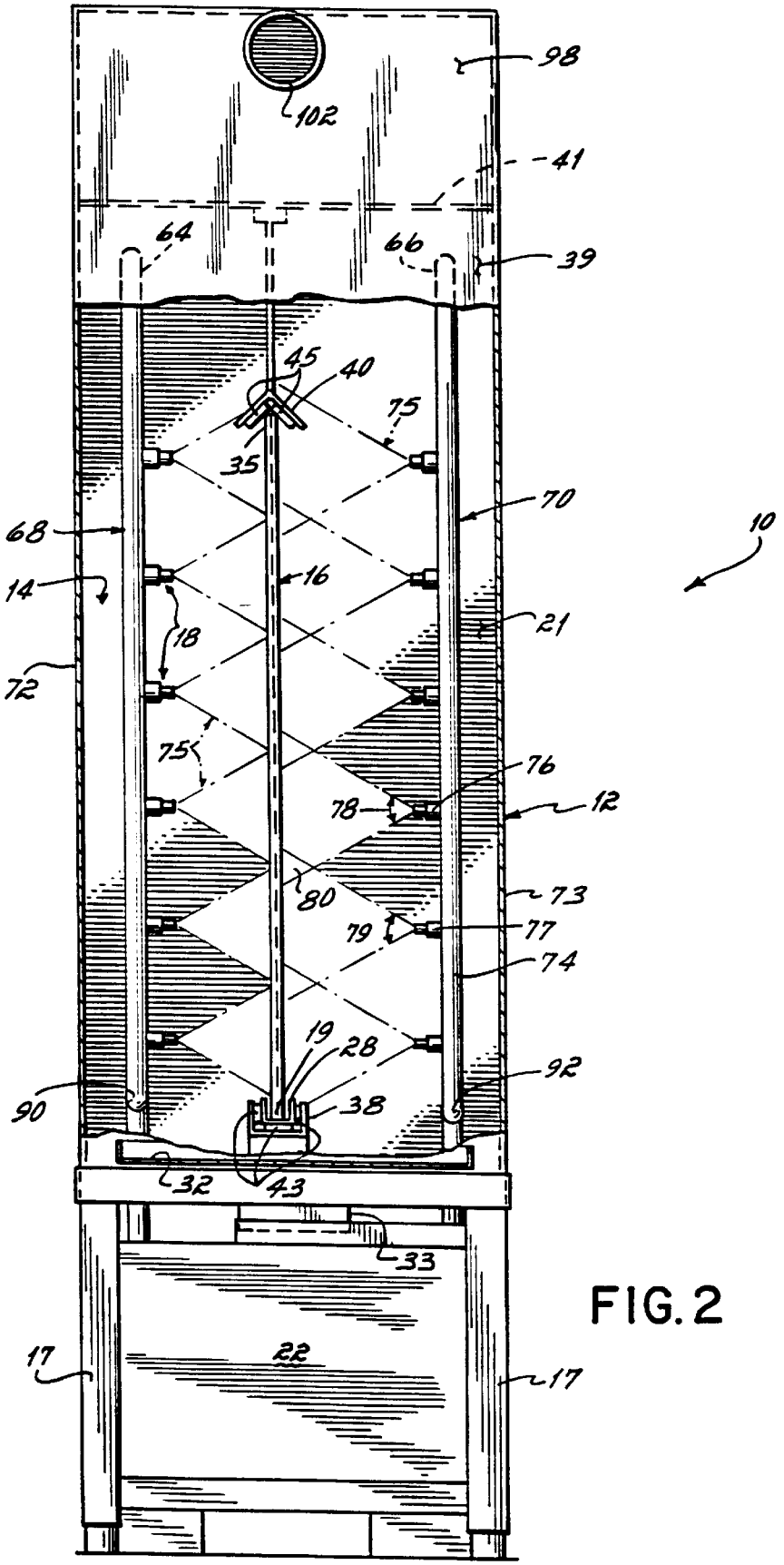
FIG. 2 is an end view of the embodiment of the present invention shown in FIG. 1 taken along lines 2—2 of FIG. 1.

The oscillator screen washing apparatus 10 of the present invention as illustrated in FIG. 1 includes an enclosed housing 12 which forms a cleaning chamber 14 therein for receiving a printing screen 16 (See FIG. 2). Housing 12 is preferably formed of fourteen gauge stainless steel and is supported above a floor surface by legs 17. A plurality of spray nozzles 18 are connected, via a supply line 20, to a reservoir 22 containing an amount of cleaning solvent or cleaning liquid 24. Suitable cleaning compositions are disclosed in U.S. Pat. No. 4,664,721, and components of those compositions may also be used as cleaning liquids, and such disclosures are incorporated herein by reference. The cleaning solvent 24 is pumped from reservoir 22 by pump 23 through line 20 to nozzles 18 which spray the screen 16 with solvent to remove printing inks or dyes from the screen 16 so that the screen may be re-used.

While screen 16 is being sprayed, an oscillating mechanism 25 moves screen 16 back and forth within chamber 14 in front of the spray nozzles 18 to more effectively and more efficiently clean the screen. Oscillating mechanism 25 comprises a push-pull device 26, which is connected to a movable track 28 which holds and supports screen 16 at a bottom edge 19 of the screen (See FIG. 2).

The push-pull device 26 is mounted on a support platform 27 which extends from the rear end 21 of housing 12, and push-pull device 26 includes an actuatable plunger 29 which extends in a longitudinal direction with respect to housing 12. The plunger 29 of push-pull device 26 is coupled to track 28, and when the push-pull device 26 is actuated, the plunger slides the track 28 and screen 16 lengthwise back and forth inside housing 12 in an oscillating motion. The oscillating movement provided by oscillating mechanism 26 ensures that the plurality of spray nozzles 18 repeatedly cover all areas of the screen 16 with sprayed cleaning solvent 24.

Preferably, and as discussed in greater detail below, the plurality of nozzles 18 are arranged in two separate grid patterns one on each side of the cleaning chamber 14 to spray both sides of screen 16 simultaneously. This provides improved cleaning and removal of undesired printing inks and other contaminants from the screen 16. The floor 32 of housing 12 is sloped to form a funnel-shaped surface so that used sprayed cleaning solution or solvent, which drips from the sprayed screen 16, falls against floor 32 and is drained into reservoir 22 through a drain opening 33. The collected solvent may then be pumped again back through line 20 and nozzles 18 to be resprayed against screen 16. In this way, the cleaning solvent 24 is re-used repeatedly rather than wasted, thus resulting in substantial cost savings. The high capacity spray capability of the present invention ensures effective cleaning of screen 16 with the re-used spray as will be discussed in greater detail below.

To clean a printing screen 16, the screen is placed into housing 12 and cleaning chamber 14 through an access opening 34 formed in one end of housing 12. Access opening 34 is covered by a hinged door 36 or some similar closure to completely seal the cleaning chamber 14 within housing 12. A drip pan 37 extends outwardly from the front end 39 of housing 12 beneath access opening 34 to catch cleaning solvent which drips from the screen 16 when it is removed from the cleaning chamber 14 after it has been sprayed and cleaned. This prevents cleaning solution or solvent 24 from being spilled on the floor surface and entering the environment. Inside the cleaning chamber 14, the bottom edge 19 of screen 16 is placed onto a movable track 28 which is moved back and forth or oscillated by push-pull device 26 of the oscillating mechanism 25. Track 28 moves within a larger channel 38 and specifically slides lengthwise in channel 38. Channel 38 is mounted longitudinally within housing 12 to support track 28 and screen 16 above the sloped floor 32 of housing 12. A layer 43 of a low friction material, such as ultra high molecular density polyethylene (UHMDPE) is inserted between track 28 and channel 38 to ensure smooth movement and oscillation of track 28 within channel 38. As shown in FIG. 2, a top edge 35 of screen 16 engages a guide channel 40 which is suspended from a top wall 41 of the housing 12. The guide channel 40 ensures that the screen 16 is held generally vertically between the opposing grids of spray nozzles 18 for more effective cleaning of the screen. Guide channel 40 also preferably includes a layer 45 of the low friction UHMDPE to ensure smooth movement of screen edge 39 along the guide channel 40.

The oscillating mechanism 25 moves track 28 within channel 38 and oscillates screen 16 back and forth in front of the opposing grids of spray nozzles 18. As mentioned, the oscillating mechanism 25 includes a push-pull device 26 such as a pneumatically operated solenoid. Other mechanically oscillating devices might also be utilized in place of push-pull device 26. The device 26 is shown on the outside of the body 47, but also may be mounted on the inside. The plunger 29 of the push-pull device 26 moves longitudinally in a straight direction inside a body 47 of the push-pull device 26 when the device is actuated, such as by pressurized air. The plunger 29 is coupled through a coupling fixture 48 to an arm 49 which is fixed at one end to track 28. Arm 49 extends into housing 12 through a liquid seal 50 which guides arm 49 to ensure a smooth, straight and generally longitudinal movement of arm 49 and track 28 inside the cleaning chamber 14. The liquid seal 50 protects from loss of cleaning liquid through hole in housing 12. When the push-pull mechanism 26 is actuated, plunger 29 moves back and forth thereby pulling and pushing track 28 and oscillating screen 16 between the spray nozzles 18.

Generally, push-pull device 26 of the present invention and arm 49 should be dimensioned to provide a range or period of motion of from about 3 to about 20" and preferably around 10". That is, it has been determined that movement of screen 16 approximately 10" in a forward motion and then 10" in a rearward motion in accordance with the principles of the present invention provides excellent cleaning. However, greater or lesser periods of motion might be utilized. Further, it has been determined that an oscillator frequency of approximately 20 cycles per minute for the oscillating mechanism 25 of the present invention is a sufficient oscillating motion to provide an efficient and effective screen cleaning. A single cycle of the oscillating mechanism 26 involves moving the track 28 the full range or period of the motion, e.g., 10", and then back again. Of course, a faster or slower oscillation frequency may be utilized as appropriate to sufficiently clean screen 16.

The oscillator screen cleaning mechanism of the present invention will now be described in greater detail with respect to its operation and the delivery of the sprayed cleaning solution or solvent 24 to the screen 16. Specifically, a cleaning liquid or cleaning solvent 24 is placed in reservoir 22 which may be made of stainless steel and preferably has a capacity of, for example around 55 gallons, depending upon the size of the machine. A suitable cleaning solvent for cleaning printing screen 16 in accordance with the teachings of the present invention is disclosed in U.S. Pat. No. 4,664,721. However, the oscillator screen washing apparatus 10 of the present invention is not limited to the use of a particular solvent, and other appropriate solvents might be placed within reservoir 22.

When the oscillator screen cleaning apparatus 10 is actuated, the solvent is pumped through the supply line 20 by pump 23. Pump 23 is preferably a high capacity pump, to deliver, for example, about 150 to about 180 gallons per minute, depending on machine size as stated above. A short section 54 of supply line 20 connects reservoir 22 and pump 23 and includes manual valves 55 and 56 which may be closed to prohibit solvent 24 from exiting reservoir 22 or draining back from pump 23, respectively, such as when it is desirable to remove reservoir 22 for maintenance.

When valves 55, 56 are open, the pump 23 pumps solvent 24 through line section 54 and up through a filter line section 58 into a filter unit 59. Filter unit 59 removes foreign particles and contaminants within the cleaning solvent 24 in line 20 before the solvent 24 is delivered to the spray nozzles 18. A suitable filter for such a purpose is the 50 micron bag filter which removes different materials such as tape, mesh, adhesive, dry ink and stencil particles. Filter unit 59 allows the solvent 24 to be continually re-used to spray screen 16. As mentioned above, the re-use of the solvent 24 amounts to a substantial cost savings, because the used solvent may be collected and filtered rather than continually replaced with new solvent. After the solvent is filtered, it is directed through line 20 to the spray nozzles 18. A valve 60 is connected in the supply line 20 and may be closed to prevent liquid 24 in line 20 from back flowing into filter 59 during filter maintenance.

The supply line 20 branches at a point along its length, such as point 61, to direct cleaning solvent to the spray nozzles 18 on both sides of the cleaning chamber. Specifically, as shown in FIG. 2, the solvent is directed into supply branches 64, 66 located proximate the top of the cleaning chamber 14. The branches 64, 66, in turn, feed into pluralities of vertically extending finger lines 68, 70, respectively, which are coupled to their respective supply branches 64, 66 and extend generally vertically from the top of the cleaning chamber 14 to the bottom of the cleaning chamber. Referring now to FIG. 2, branch 64 feeds the first plurality of finger lines 68 while branch 66 feeds a second plurality of finger lines 70. Each vertical finger line contains a plurality of spray nozzles 18 arranged in a generally straight vertical line thereon. The nozzles 18 are vertically spaced apart along the lengths of each finger line. The individual finger lines of the pluralities 68, 70 are horizontally spaced apart one from the other and extend generally parallel with each other from their respective supply branches. The finger lines of each plurality 68, 70 are also generally coplanar with each other such that each plurality of finger lines 68, 70 defines a spraying plane of nozzles 18 as illustrated in FIG. 2. The spraying planes of nozzles 18 are generally vertically oriented and are parallel the side walls, such as side walls 72, 73, of the housing 12. The combination of the horizontally spaced apart finger lines 68, 70 and the vertically spaced apart nozzles 18 creates opposing grids of spray nozzles 18 within cleaning chamber 14. The opposing grids of spray nozzles ensures that, while screen 16 is oscillated within the cleaning chamber 14, the entire screen area is constantly being sprayed with cleaning solvent 24 to effectively and efficiently clean the screen.

Referring again to FIG. 2, each nozzle 18 forms a generally V-shaped flat spray pattern 75 on screen 16. Cleaning solvent impingement created by nozzles helps remove ink and dye residue. The flat spray pattern 75 is vertically oriented so that the horizontal oscillating motion provided by oscillating mechanism 25 moves the screen 16 perpendicular to the flat spray pattern of each nozzle 18. The nozzles 18 of each finger line, such as finger line 74, are spaced along the finger line 74 to provide pattern overlap of the spray patterns. For example, nozzles 76 and 77 of finger line 74 provide flat spray patterns 78, 79, respectively. The nozzles 76, 77 are spaced such that their spray patterns overlap at area 80. The overlapping spray patterns ensure complete coverage of screen 16 with the sprayed solvent. A nozzle suitable for use within the present invention yields a spray pattern approximately ten inches wide.

The oscillator screen cleaning apparatus of the present invention is capable of delivering a high quantity of sprayed cleaning solvent to screen 16 during a cleaning cycle. Specifically, the spraying system of the present invention, including high capacity pump 23 and the opposing grids of spray nozzles 18, is operable to deliver sprayed cleaning solvent to the screen 16 at a rate in the range of about 150 to about 180 gallons per minute. The high solvent delivery rate and the continual coverage over the area of the screen in combination with the oscillating screen motion of the present invention yields a very efficient cleaning cycle.

As discussed above, the cleaning solvent 24 is continually filtered and re-used within the oscillator screen cleaning apparatus of the present invention. Specifically, the cleaning solvent 24 sprayed onto screen 16 by nozzles 18 drips from the screen and falls onto the sloped floor 32 of housing 12 where it is directed through drain opening 33 back into reservoir 22. The used solvent is again pumped through line 20 and filter unit 59 to be directed to the grids of spray nozzles 18. As discussed, continual re-use of the cleaning solvent yields substantial cost savings and the high spray capacity and suspension of ink particles within the solvent ensures that the re-used cleaning solvent effectively cleans screen 16.

After several cleaning cycles, the used solvent within reservoir 24 may need to be recycled. To do so, the used solvent may be transferred to a decantation tank either manually or through a line and pump coupled to the reservoir 22. Referring now to FIG. 1, in one embodiment of the present invention, decantation tank 82 is coupled to reservoir 22 through line 84 and pump 86. The used cleaning solvent is pumped into the decantation tank 82 wherein the ink and other contaminant particles which are suspended in the solvent are allowed to settle. The decanted solvent may then be removed from tank 82 and transferred back into reservoir 22 for additional use within the oscillator screen cleaning apparatus 10.

The spraying system of the oscillator screen cleaning apparatus 10 of the present invention is configured to be quickly drained when desired such as for decantation and recycling of the cleaning solvent 24. Specifically, referring to FIG. 1, each finger line of the finger line pluralities 68, 70 terminates in a respective draining branch 90, 92. The draining branches 90, 92 extend generally parallel to the respective supply branches 64, 66, respectively, and receive any solvent which is not sprayed through the nozzles 18. The draining branches 90, 92 beneath the cleaning chamber 14 converge at point 94 and are connected through a dump valve 96 into reservoir 22. When the dump valve 96 is actuated, either manually or pneumatically, the entire system including supply branches 64, 66 and finger lines 68, 70, is drained of cleaning fluid in approximately 5 seconds. This provides rapid draining of fingers to decrease cycle time and to reduce vapors in chamber.

Housing 12 completely encloses the finger lines 68, 70 and spray nozzles 18 to ensure that all of the cleaning solvent 24 is contained within cleaning chamber 14 and that little or none of the solvent escapes into the atmosphere or the environment around the oscillator screen cleaning apparatus 10. This provides a safer, healthier environment for personal working near the cleaning apparatus 10. Further, the housing 12 has a flue 98 formed in the top thereof which is coupled to a vapor recovery system 100 through an opening 102 in flue 98. The vapor recovery system ensures that vaporized solvent from cleaning chamber 14 does not escape into the atmosphere to be breathed in by workers, thereby further creating a more healthy work environment. A removable cover 104 on the top wall 41 of housing 12 allows access to the cleaning chamber 14 from above.

In view of the above detailed description, the oscillator screen cleaning apparatus and methods of the present invention provide distinct advantages over the products and methods now available for cleaning printing screens. While the present invention has been illustrated by the description of the embodiments thereof, and while the embodiments have been described in considerable detail, it is not the intention of applicant to restrict or in any way limit the scope of the appended claims as such detail. Additional advantages and modifications will readily be apparent to a person of ordinary skill in the art. Therefore, the invention in its broader aspects is not limited to the specific details, representative apparatus, and method and illustrative examples shown and described hereinabove. Departures may be made from such details without departure from the scope of the applicant's general inventive concept.

What is claimed is:

1. A method for cleaning a screen with a spray cleaning liquid comprising:

placing a screen within within a chember proximate a first plurality of spraynozzes positioned within the chamber;

positioning the screen on a movable track in a chamber track to an oscillating, the mechanism including a push-pull device which is operable for pushing and pulling the track in the chamber;

repeatedly pushing and pulling the track for moving said screen in a repeated, continuous oscillating motion within said cleaning chamber to thus move the screen repeatedly back and forth in front of the spray nozzles whereby to increase the coverage of the sprayed cleaning liquid over said screen for improved cleaning and removal of undesired contaminants from said screen.

2. The method of claim 1 wherein the cleaning chamber includes second plurality of spray nozzles opposite the first plurality of spray nozzles, the second plurality of spray nozzles spraying cleaning liquid in an opposite direction from the first plurality of spray nozzles, the method further comprising moving said screen between said spray nozzles to clean the screen from both sides.

3. The method of claim 2 further comprising spraying the cleaning liquid on said screen at a rate in the range of about 150 to about 180 gallons per minute.

4. The method of claim 1 further comprising positioning the spray nozzles of the plurality in a grid pattern of horizontally and vertically spaced-apart nozzles to increase the screen coverage of the sprayed cleaning liquid.

5. The method of claim 1 further comprising collecting used cleaning liquid after it has been sprayed on the screen and supplying the used cleaning liquid to the spray nozzles whereby to recycle the cleaning liquid.

6. The method of claim 5 further comprising filtering the used cleaning liquid before supplying the used cleaning liquid to the spray nozzles.

7. The method of claim 1 further comprising collecting used cleaning liquid after it has been sprayed on the screen and decanting the used liquid to remove contaminants therefrom.

8. The method of claim 1 further comprising pushing and pulling the track for moving said screen in an oscillating motion with a period of motion in the range of 5 to 15 inches.

9. The method of claim 1 further comprising enclosing said cleaning chamber and spray nozzles within a housing to prevent cleaning liquid from entering the atmosphere.

10. The method of claim 1 further comprising moving said screen in a complete period of the oscillating motion approximately 20 times per minute.

11. The method of claim 1 wherein the cleaning liquid is a solvent.

12. The method of claim 1 further comprising recovering the cleaning liquid which has been vaporized during the cleaning of said screen.

* * * * *

UNITED STATES PATENT AND TRADEMARK OFFICE

CERTIFICATE OF CORRECTION

PATENT NO. : 5,769,956

DATED : June 23, 1998

INVENTOR(S) : Albert B. Cord et al.

It is certified that error appears in the above-identified patent and that said Letters Patent is hereby corrected as shown below:

Column 8, line 45, delete the second repetition of "within".

Column 8, line 46, delete "spraynozzes" and insert --spray nozzles--.

Column 8, line 46, delete "within" and insert --inside--.

Column 8, line 47, delete "a" (2nd occ.) and insert --the--.

Column 8, line 47, after "chamber" add --, the--.

Column 8, lines 48-50, delete "track to an oscillating, the mechanism including a push-pull device which is operable for pushing and pulling the track in the chamber,"

and insert --operable for moving in front of the spray nozzles;

supplying cleaning liquid to the spray nozzles to spray the screen and remove contaminants therefrom;

coupling the track to an oscillating mechanism including a push-pull device which is operable for pushing and pulling the track in the chamber--.

UNITED STATES PATENT AND TRADEMARK OFFICE

CERTIFICATE OF CORRECTION

PATENT NO. : 5,769,956
DATED : June 23, 1998
INVENTOR(S) : Albert B. Cord et al.

It is certified that error appears in the above-identified patent and that said Letters Patent is hereby corrected as shown below:

Column 8, line 59, after "includes" insert --a--.

Signed and Sealed this

Twenty-seventh Day of October, 1998

*Attest:*

BRUCE LEHMAN

*Attesting Officer*

*Commissioner of Patents and Trademarks*